US005946733A

United States Patent [19]

Spooner

[11] Patent Number: 5,946,733

[45] Date of Patent: Sep. 7, 1999

[54] BELT SUPPORTED HOLDER FOR CONSTRUCTION WORKERS' SAFETY GLOVES

[76] Inventor: Keith Spooner, 962 Troy Ave., Brooklyn, N.Y. 11203

[21] Appl. No.: 09/114,805

[22] Filed: Jul. 13, 1998

[51] Int. Cl.[6] ..... A41F 9/00; A41D 19/00; A44B 21/00

[52] U.S. Cl. ..... 2/312; 2/160; 2/319; 24/904; 224/933

[58] Field of Search ..... 2/160, 312, 314, 2/315, 319, 320, 337, 271; 24/3.1, 3.11, 3.12, 904; 224/575, 576, 163, 182, 191, 194, 195, 663, 664, 665, 666, 667, 669, 268, 269, 904, 933; 206/278

[56] References Cited

U.S. PATENT DOCUMENTS

| | | |
|---|---|---|
| D. 351,933 | 11/1994 | Stoneman . |
| 409,239 | 8/1889 | Roller . |
| 781,629 | 2/1905 | Alhstrom . |
| 2,320,067 | 5/1943 | Caughren . |
| 2,665,830 | 1/1954 | Fowler . |
| 3,279,009 | 10/1966 | Deane . |
| 3,963,156 | 6/1976 | Perrin . |
| 4,351,067 | 9/1982 | Bartels . |
| 4,358,036 | 11/1982 | Maltais . |
| 4,587,818 | 5/1986 | Griffin . |
| 4,977,860 | 12/1990 | Harwell . |
| 5,248,072 | 9/1993 | Jones . |
| 5,265,785 | 11/1993 | Chudy . |
| 5,586,674 | 12/1996 | Nachbauer . |
| 5,619,774 | 4/1997 | Perry . |
| 5,687,892 | 11/1997 | Johns . |
| 5,864,925 | 2/1999 | McGee . |

*Primary Examiner*—John J. Calvert
*Assistant Examiner*—Shirra L. Jenkins
*Attorney, Agent, or Firm*—Myron Amer PC

[57] ABSTRACT

A holder for bulky construction worker's gloves during their non-use, wherein the holder is attached by downwardly facing clips to the construction worker's belt and the gloves inserted within upwardly facing clips of resilient plastic construction material so that the bulk of the gloves opens the clips and the urgency of the resilient plastic material closes the clips upon the gloves to hold them in place.

1 Claim, 1 Drawing Sheet

BELT SUPPORTED HOLDER FOR CONSTRUCTION WORKERS' SAFETY GLOVES

The present invention relates generally to an article of convenience for primarily a construction worker who, to avoid hand injuries, typically wears protective or safety gloves and, more particularly, to a belt-attached holder for the gloves during intervals of non-use.

EXAMPLE OF THE PRIOR ART

It is known by common experience that work gloves of the nature involved are of a necessary construction material as is necessary to protect the wearer against hand injuries. An unavoidable consequence is that the gloves are bulky and of a size which is not pocket-size, and thus the storage of the work gloves when not being used is an inconvenience.

A prior art solution specifically concerned with work gloves is set forth in U.S. Pat. No. 5,265,785 issued to Thomas G. Chudy for "Protective Glove Provider" on Nov. 30, 1993, in which a belt-attached canister bounding a compartment sized and shaped to the dimensions of the work gloves is used for storage of the work gloves during their non-use. The '785 canister's size and shape and outwardly protruding orientation from the user's belt is not desirable since it typically interferes with hand and arm movements.

Broadly, it is an object of the present invention to provide a work gloves' belt-attached holder overcoming the foregoing and other shortcomings of the prior art.

More particularly, it is an object to use to advantage the bulk of the work gloves to achieve a spring urgency in the within inventive holder to hold the work gloves in place, as well as attaining other noteworthy benefits, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

It is known by common experience that construction workers in particular, as well as other workers vulnerable to hand injuries, use work gloves 10 fabricated of a construction material appropriate to protect against injury, and as a consequence of the construction material used this unavoidably adds to the bulk of the gloves. In fact, because of their significant bulk, the work gloves 10 when not in use, cannot readily be inserted into a pocket or the like, since, as noted, they typically are not pocket-size, and thus the non-use storage of work gloves is an inconvenience.

Figure 1:
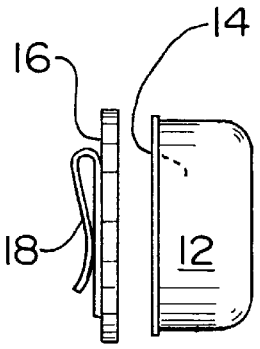
FIG. 1 PRIOR ART
FIG. 1 is a side elevational view of a prior art storage holder for work gloves.
Figure 2:
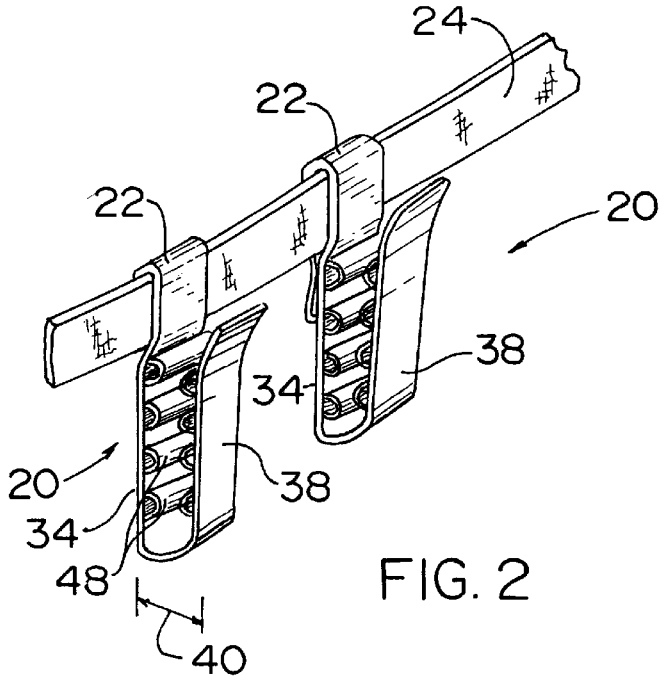
FIG. 2 is a perspective view of the within inventive work gloves holder.
Figure 3:
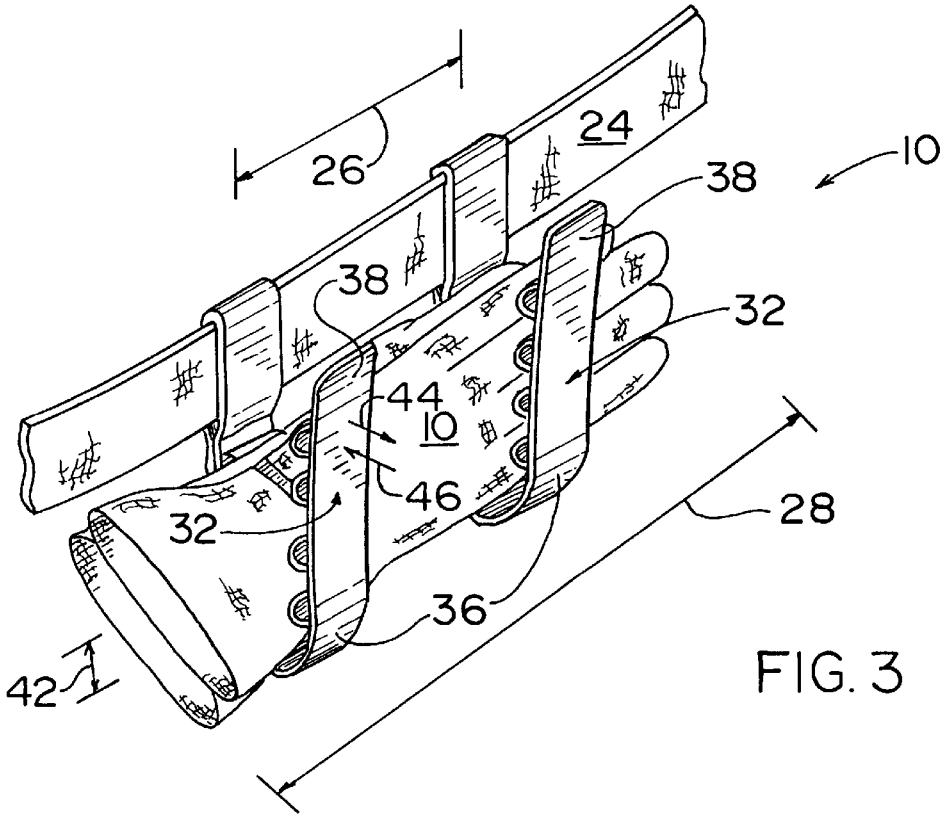
FIG. 3 is a view similar to FIG. 2, in slightly enlarged scale, illustrating the work gloves in place in the holder.

As exemplified by U.S. Pat. No. 5,265,785 issued to Chudy for "Protective Glove Provider" on Nov. 30, 1993, and as illustrated in FIG. 1, the solution to the inconvenience of non-used work gloves is the use of a canister 12 with a compartment 14 sized to receive therein work gloves (not shown in FIG. 1), and having a compartment closure 16 with an attached spring clip 18 for attachment to a worker's belt or the like.

In contrast, the within inventive holder uses to advantage the hard-to-manage bulk of the protective or work gloves 10 to effectively store the gloves in a desirable out-of-way location and under spring urgency, all as will be better understood as the description proceeds.

In a preferred embodiment, two identical belt-attached holders, generally designated 20, each having an inverted U-shaped resilient belt-engaging hook means 22 and clipped to a waist-encircling belt 24 in slightly spaced apart relation so that the distance 26 therebetween can be correspondingly adjusted to the length 28 of the gloves 10.

Integral to each hook 22 is an upwardly disposed U-shape 32 of springy construction material having a first leg 34 depending from the hook means 22 and after a reverse direction bend, as at 36, having a second leg 38 in a selected distance 40 spaced from the first leg 34, the distance 40 selected being understood to be slightly undersized with respect to the bulk or width 42 of the gloves 10.

In use, the gloves 10 are manually inserted in the clearance 40 between the cooperating legs 34, 38, in a generally horizontal orientation as illustrated, and thus assume an out-of-the way location which does not inhibit the use of arms and hands. Because of the size differences 40 and 42, each leg 38 during the positioning of the gloves 10 in the holders 20 undergoes opening movement 44, which is followed by closing movement 46 due to spring urgency of the construction material of the bend 36 and second leg 38, which, in practice, has been found to securely hold the gloves 10 in place until intentionally manually removed preparatory to construction work service.

Optionally, undulations, individually and collectively designated 48, are provided in alternately spaced relation on the surfaces of the legs 34 and 38 that are in facing relation to each other, so that the gloves in an interposed position between the legs 34 and 38 assumed an undulating configuration which further enhances the grip of the holders 20 on the gloves 10.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In combination, a belt-supported holder and work gloves comprising:

said belt-supported holder comprising a belt in encircling relationship to a wearer's waist;

a pair of spaced apart belt hooks, said belt hooks having a downwardly facing hook means for attachment to said belt along a predetermined length, each of said hook means having a first leg integrally formed thereto each of said first leg ending in a reverse bend and extending upwardly into a second leg such that the first and second legs form an upwardly facing U-shape integral to said hook means, said U-shape being made from resilient material, said first and second legs being spaced a nominal distance apart to form a clearance distance;

a pair of work gloves constructed of bulky protective material wherein said gloves, when inserted lengthwise along said first and second legs in an operative position and are held in place between said first and second legs when said U-shape is biased into a closed position.

* * * * *